US005568236A

United States Patent [19]

Toda et al.

[11] Patent Number: 5,568,236

[45] Date of Patent: Oct. 22, 1996

[54] ONE-COMPONENT DEVELOPING DEVICE WITH SYSTEM FOR REMOVING SURPLUS TONER

[75] Inventors: Hiroshi Toda; Akihiro Kawasaki, both of Toyokawa; Masami Eda, Itami; Shinichi Takemoto; Tamotsu Sakuraba, both of Toyokawa, all of Japan

[73] Assignee: Minolta Co., Ltd., Osaka, Japan

[21] Appl. No.: 303,221

[22] Filed: Sep. 8, 1994

Related U.S. Application Data

[63] Continuation-in-part of Ser. No. 88,527, Jul. 9, 1993, abandoned.

[30] Foreign Application Priority Data

| | | | |
|---|---|---|---|
| Jul. 10, 1992 | [JP] | Japan | 4-183341 |
| May 26, 1993 | [JP] | Japan | 5-123757 |
| Dec. 27, 1993 | [JP] | Japan | 5-330914 |

[51] Int. Cl.[6] ..... G03G 15/06; G03G 21/00

[52] U.S. Cl. ..... 355/259; 355/215; 355/246

[58] Field of Search ..... 355/245, 246, 355/250–253, 259, 299, 215; 118/651, 653, 655, 656, 657, 658, 661; 430/120, 126

[56] References Cited

U.S. PATENT DOCUMENTS

| | | | |
|---|---|---|---|
| 4,264,191 | 4/1981 | Gerbasi et al. | 355/299 |
| 4,410,259 | 10/1983 | Yamagata et al. | 355/259 |
| 4,561,381 | 12/1985 | Kaneko et al. | 118/652 |
| 4,619,517 | 10/1986 | Ruhland | 355/259 |
| 4,745,429 | 5/1988 | Mukai et al. | 118/656 X |
| 4,791,882 | 12/1988 | Enoguchi et al. | 118/653 |
| 4,809,034 | 2/1989 | Murasaki et al. | 355/253 |
| 4,917,043 | 4/1990 | Yokoyama | 118/658 |
| 4,930,438 | 5/1990 | Demizu et al. | 118/651 |
| 5,017,967 | 5/1991 | Koga | 355/261 |
| 5,168,312 | 12/1992 | Aoto et al. | 355/259 |
| 5,170,213 | 12/1992 | Yamaguchi et al. | 355/246 |
| 5,183,964 | 2/1993 | Stelter et al. | 118/653 |
| 5,206,691 | 4/1993 | Mizuno et al. | 355/259 |
| 5,210,575 | 5/1993 | Kikuchi | 355/259 |
| 5,389,487 | 2/1995 | Kawakami et al. | 430/120 |
| 5,488,462 | 1/1996 | Ishikawa et al. | 355/215 |

FOREIGN PATENT DOCUMENTS 61-245176 10/1986 Japan .

*Primary Examiner*—Arthur T. Grimley
*Assistant Examiner*—Shuk Y. Lee
*Attorney, Agent, or Firm*—Burns, Doane, Swecker & Mathis, LLP

[57] ABSTRACT

An one-component developing device includes an electrically conductive member which is located in a region extending from a position downstream, with respect to a moving direction of a surface of a toner carrying member, to a developing region, and is in contact with the surface of the toner carrying member. A surface of the electrically conductive member contacting the developing sleeve is formed of material, of which charge polarity is shifted to the same polarity side as a regular charge polarity of the toner in view of charge series, and which contains highly conductive material dispersed therein.

39 Claims, 10 Drawing Sheets

ONE-COMPONENT DEVELOPING DEVICE WITH SYSTEM FOR REMOVING SURPLUS TONER

This application is a continuation-in-part of the application Ser. No. 08/088,527 filed on Jul. 9, 1993, now abandoned.

BACKGROUND OF THE INVENTION

1. Field of the Invention

The present invention relates to a developing device used in image forming apparatuses such as a copying machine and a printer for developing an electrostatic latent image formed on an electrostatic latent image carrier into a visible form.

In particular, the invention relates to an one-component developing device, in which toner supplied to a toner carrying member having a moving surface is passed between the surface and a toner restricting member contacting the above surface for forming a thin layer of charged toner held on the surface to be transferred and supplied to a developing region for the developing process, and remaining surplus toner which was not consumed in the developing process is returned to a toner supply side while being held on the toner carrying member.

2. Description of the Related Art

An example of such one-component developing device is schematically shown in FIG. 15.

The developing device shown in FIG. 15 includes a drive roller 91 which is driven by unillustrated drive means in the CCW direction in the figure. A flexible developing sleeve 92 is fitted around the drive roller 91. The developing sleeve 92 has an inner diameter slightly larger than an outer diameter of the drive roller 91. The sleeve is pressed against the drive roller 91 by a pressing guide 93 contacting rear sides of the opposite ends of the sleeve 92, and thereby a slackened portion 920 is formed at a position diametrally opposite to the pressed portions. The slackened portion 920 softly contacts an electrostatic latent image carrier (a photosensitive drum in this example) PC. A toner restricting blade 94 also contacts the developing sleeve 92 from the same side as the pressing guide 93.

At the rear of the developing sleeve 92, there is provided a buffer chamber 95, and a toner supply chamber 96 is provided at the rear of the buffer chamber 95. A toner supply rotary member 97 rotating in the CCW direction is arranged in the buffer chamber 95, and a toner agitating and supplying rotary member 98 rotating in the CW direction is arranged in the toner supply chamber 96.

A lower sealing member 99 is in contact with the lower surface of the developing sleeve 92 for preventing external leak of the toner from the buffer chamber 95.

In this developing device, the toner T, which was supplied from the toner supply chamber 96 into the buffer chamber 95 by the rotation of the rotary member 98, is sequentially supplied onto the surface of the developing sleeve 92 by the rotation of the toner supply rotary member 97.

Meanwhile, the toner T supplied to the sleeve 92, which is frictionally driven by the rotating drive roller 91, passes between the toner restricting blade 94 and the sleeve 92 and is thereby frictionally charged owing to the pressure by the blade 94. Also, the toner T, which takes a form of a thin layer of a predetermined thickness and is held on the sleeve surface, is transferred to the developing region confronting the photosensitive drum PC, and is used for developing the electrostatic latent image with a developing bias $V_B$ supplied by a power supply 921.

Surplus toner T after the development passes between the sealing member 99 and the sleeve 92 into the buffer chamber 95 in accordance with the rotation of the sleeve 92.

A major part of the toner returned into the buffer chamber 95 is separated from the sleeve 92, but a part of the highly charged toner remains on the surface of the sleeve 92. The remaining toner forms a micro electric field between it and the sleeve 92, and this electric field will attract the subsequently supplied toner onto the sleeve surface.

However, if the fluidity of the toner increases above the ordinary value, for example, under a low humidity environment, the chargeability of the toner also increases. This tends to increase the amount of the highly charged toner which is accumulated on the developing sleeve 92 without moving away from the same, and thus tends to increase the amount of the toner attracted to the developing sleeve 92. In this case, the restricting blade 94 cannot sufficiently restricts the amount of the toner adhered onto the sleeve 92, resulting in such disadvantage (so-called abnormal adhesion of toner) that an excessively large amount of the toner is transferred to the photosensitive drum PC and a non-image portion is also developed with the toner.

The restricting blade 94 repetitively applies the stress to the toner accumulated on the developing sleeve 92, so that the toner spreads and solidifies over the sleeve, which causes so-called filming of the toner, resulting in deterioration of the image quality. The stress described above is liable to deteriorate the toner (e.g., reduction of a diameter of toner particles and/or drop of fluidizing agent, i.e., silica), and thus may deteriorate a property such as followability to solid black.

Further, if the amount of the toner accumulated on the sleeve 92 increases, the toner newly supplied to the sleeve 92 is charged by the mutual friction of the toner in addition to the normal friction with the restricting blade 94, so that the amount of the toner having a polarity opposite to the regular charge polarity increases, resulting in deterioration of the image quality.

For the purposes of suppressing phenomena such as the abnormal adhesion of toner, filming of toner and deterioration of toner, the degree of charging by the friction may be reduced, for example, by reducing a width of mutually contacting planes of the toner restricting blade 94 and the sleeve 92 in order to adjust the amount of charge of the toner and to prevent the charge-up. In this case, the charge amount of the toner can be reduced and the micro-electric field formed between the toner and the sleeve 92 is weakened, so that separation of the toner from the sleeve 92 is promoted.

If the charge of the toner is reduced prior to the development of the electrostatic latent image, as described above, problems such as fog adhesion in the background and dispersion of toner around characters may generate after the development of solid black which is not subjected to the repetitive sliding by the restricting blade 94, because the charging ability of the restricting blade 94 has been reduced, in the case where the toner has the low chargeability due to the reduction of the fluidity, e.g., by the drop of fluidizing agent (silica) after the image forming operation was repeated many times, or in the case where the toner has a low chargeability due to a high humidity environment.

Further, in recent years, demands for reproduction of high resolution images have been increased. Since the quality of reproduced images depends on a particle diameter of toner, toner made of particles of a small diameter has been proposed. However, in the one-component developing device already described, remarkably presents in addition to the problem already described a problem that toner remaining on the sleeve 92 after the development, and particularly, toner formed of particles of a small diameter will not leave the sleeve 92 and be accumulated thereon, so that memory will generate on the sleeve and quality of the image will deteriorate after printing of many sheets.

Accordingly, it is an object of the invention to provide an one-component developing device for developing an electrostatic latent image on an electrostatic latent image carrier, wherein remaining surplus toner which was not consumed in the developing process can be easily separated from a toner carrying member even after an image forming operation was repeated many times, and thereby an amount of the toner transferred to a developing region and a charge of the toner are appropriately maintained to prevent problems such as accumulation of the toner on the toner carrying member, deterioration of the toner and filming of the toner, and thus, to obtain an image of a high quality without fog adhesion and dispersion.

Another object of the invention is to provide an one-component developing device for developing an electrostatic latent image on an electrostatic latent image carrier which can prevent disadvantageous accumulation of toner on a toner carrying member, filming of toner on the toner carrying member and deterioration of toner, and further, can prevent disadvantageous memory on the toner carrying member, which may be caused when using toner formed of particles of a small diameter, as well as deterioration of the image quality after printing of many sheets.

SUMMARY OF THE INVENTION

In order to achieve the above object, the present invention provides an one-component developing device having following features.

The one-component developing device (first developing device) includes:

a toner carrying member which is opposed to an electrostatic latent image carrier and has a movable surface for holding the toner thereon, a toner restricting member located at a position, which is upstream, with respect to a moving direction of the surface of the toner carrying member, to a developing region formed in opposed portions of the electrostatic latent image carrier and the toner carrying member, the toner restricting member contacting the surface of the toner carrying member, and an electrically conductive member located in a region extending from a position, which is downstream, with respect to the moving direction of the surface of the toner carrying member, to the developing region, to a position upstream to the toner restricting member, the electrically conductive member being in contact with the surface of the toner carrying member and being formed of material, of which charge polarity is in the same side as a charge polarity of the toner in view of the frictional charge series and which contains electrically conductive material dispersed therein.

A voltage for discharging the toner may be applied to the electrically conductive member, if necessary. In this case, if negatively chargeable toner is to be used, the voltage used for the discharge is larger than a surface voltage of a toner layer on the toner carrying member. If positively chargeable toner is to be used, it is smaller than the surface potential of the toner layer. A alternating voltage may be applied to the electrically conductive member.

The device may include a removing member for removing toner from the surface of the toner carrying member, which is in contact with the surface of the toner carrying member at a position downstream to the electrically conductive member and upstream to the toner restricting member with respect to the moving direction of the toner carrying member.

In order to achieve the above object, the present invention also provides an one-component developing device (second developing device) including:

a toner carrying member which is opposed to the electrostatic latent image carrier and has a movable surface for holding the toner thereon, a toner restricting member located at a position, which is upstream, with respect to a moving direction of the surface of the toner carrying member, to a developing region formed in opposed portions of the electrostatic latent image carrier and the toner carrying member, the toner restricting member contacting the surface of the toner carrying member and a voltage being applied to said toner restricting member, and an electrically conductive member located in a region extending from a position, which is downstream, with respect to the moving direction of the surface of the toner carrying member, to the developing region, to a position upstream to the toner restricting member, the electrically conductive member being in contact with the surface of the toner carrying member; and means for applying a voltage $V_{BLD}$ to said toner restricting member, the voltage $V_{BLD}$ being smaller than a voltage $V_D$ applied to the electrically conductive member in the case where the toner is negatively chargeable toner, and being larger than the voltage $V_D$ in the case where the toner is positively chargeable toner.

Also in this second developing device,the electrically conductive member may be formed of material of which charge polarity is in the same side as a charge polarity of the toner in view of the frictional charge series and the electrically conductive member may contains electrically conductive material dispersed therein.

In either developing device described above, the electrically conductive member may serve as a sealing member for preventing leak of the toner. Independently from the electrically conductive member, a sealing member, which is in contact with the surface of the toner carrying member and serves to prevent leak of the toner, may be provided at a position downstream, with respect to the moving direction of the surface of the toner carrying member, to the developing region. In this case, the toner leak preventing member may be formed of material of which charge polarity is in the same side as the charge polarity of the toner in view of the frictional charge series. The electrically conductive member may be disposed, for example, between the developing region and the sealing member for preventing leak of the toner, or may be disposed between the sealing member and the toner restricting member. In either case, the electrically conductive member may be in contact with a substantially and longitudinally entire area of the toner carrying member, and alternatively, may be in contact with an end portion in the longitudinal direction of the toner carrying member.

For example, the material of the electrically conductive member, of which charge polarity is in the same side as the charge polarity of the toner in view of the frictional charge series, may be resin, or may contains (including the case of application) charge controlling agent at the same polarity side as the charge polarity of the toner.

As the resin, of which charge polarity is shifted, with respect to that of the toner, to the same polarity side as the charge polarity of the toner in view of the charge series, fluorine-contained resin such as polytetrafluoroethylene or others may be used for the negatively chargeable toner, and polyamide (nylon), silicon-contained resin or others may be used for the positively chargeable toner. As the material having a good conductivity to be dispersed in the above material may be carbon, various electrically conductive metal particles or other appropriate charge controlling substance.

In any of the developing device, the toner carrying member may be formed of a thin-film developing sleeve, which is loosely mounted around a drive roller to be driven to rotate and has a peripheral length slightly longer than the peripheral length of the drive roller. In this case, there is provided a member for forming a slackened portion in the developing sleeve which is located in the developing region defined by opposed portions of the electrostatic latent image carrier and the toner carrying member.

Any of the developing device described above may employ such a specific structure that the toner carrying member is disposed in an opening provided at a housing, the toner restricting member is disposed in the housing, and the electrically conductive member is attached to the housing. In the developing device having the above structure, a toner storing portion which is closed with respect to an exterior is defined in the housing by the toner carrying member, the toner restricting member and the electrically conductive member. In this developing device, if the toner removing member is to be provided, it may be disposed in the toner storing portion. In any case, a voltage may be applied to the toner removing member, if provided, for smoothly moving the toner to the removing member.

The voltage, if applied, may be set such that the voltage (Vr) applied to the removing member satisfies the following relationship between the bias potential (Vr) and a surface potential ($V_B+V_T$) of the toner layer which is the sum of the developing bias potential $V_B$ applied to the toner carrying member and the potential $V_T$ of the toner layer caused by charging the toner.

If toner is negatively chargeable: $Vr>V_B+V_T$

If toner is positively chargeable: $Vr<V_B+V_T$

An alternating voltage may be applied under appropriate conditions.

The toner removing member may be a rotary member or a fixed member such as a blade. If the rotary member is employed, it may serve also as a toner supply rotary member in a buffer chamber shown in FIG. 15. If the rotary member is employed, it may be a roller having an electrically conductive brush therearound.

The removing member to which the removing bias is applied may be made of, for example, electrically conductive metal or material such as resin or rubber into which electrically conductive material is dispersed, and may be formed of, for example, a brush made of electrically conductive fibers or fibers to which electrical conductivity is applied.

According to the first developing device of the invention, the unconsumed toner, which remains after the toner held on the surface of the toner carrying member was used for the development in the developing region, passes between the surface of the toner carrying member and the electrically conductive member, which is in contact with the toner carrying member at the side downstream to the developing region and serves as the discharging member, while contacting the electrically conductive member, and returns to the toner supply side.

The toner is discharged or oppositely charged by the friction with the electrically conductive member when it contacts and passes through the electrically conductive member, and attains a state in which the toner can be easily separated from the surface of the toner carrying member to the toner supply side before it reaches the toner restricting member.

Since the material having the good conductivity is dispersed in the electrically conductive member, the electric charge, which is generated in the electrically conductive member by the friction between the member and the toner contacting and passing through the same, is removed through the member having the good conductivity, so that the electrically conductive member is prevented from accumulating the charge. Therefore, even if the image formation is repeated many times, and the toner on the toner carrying member contacts many times the electrically conductive member, the toner is discharged or oppositely charged every time it contacts the member.

If the dispersed material having the good conductivity is hard, the abrasion of the discharging member is suppressed owing to the hardness.

If the toner removing member is provided, the toner remaining on the toner carrying member after passing over the electrically conductive member is removed by the removing member from the toner carrying member, and the toner in the developing device is supplied to the toner carrying member again.

According to the second developing device of the invention, the toner is charged by the friction caused by the pass between the toner restricting member and the toner carrying member, and additionally, the charge is supplied to the toner from the toner restricting member in accordance with a potential difference between the developing bias potential $V_B$ and the voltage $V_{BLD}$ applied to the toner restricting member. Thereby, the charge amount of the toner can be controlled.

In this case, a following model expression, where an electric field $E_K$ in a plane contacting the toner is constant, is well known as a relational expression expressing the charge amount of the toner in the case where the potential difference between the toner restricting member and the toner carrying member is not taken into consideration.

$$E_K=(1/2\pi\epsilon_0)\times(q_t/r^2)+(nq_t/2\epsilon_0)$$

$q_t$: charge amount per toner particle r: diameter of toner particle n: number of toner particles per unit area $\epsilon_0$: dielectric constant This expression can be rewritten as follows in view of the external electric field (potential difference between the restricting member and the developer carrying member).

$$E_K=(1/2\pi\epsilon_0)\times(q_t/r^2)+(nq_t/2\epsilon_0)+k(V_B-V_{BLD})$$

k: constant of proportionality

Since the first and second terms in the right side represent the electric field by the toner layer at the position of the restricting member, the expression can be rewritten as follows replacing them with $E_{TB}$.

$$E_{TB}=E_K-k(V_B-V_{BLD})$$

Since the electric field $E_K$ is constant, the absolute value of the electric field $E_{TB}$ by the toner layer increases and thus the charge amount of the toner increases in accordance with the difference between $V_{BLD}$ and $V_B$ having such a relationship that $V_{BLD}$ is smaller than $V_B$ in the case of the negatively chargeable toner and is larger than $V_B$ in the case of the positively chargeable toner, when the toner passes through the restricting member.

In the developing process, the appropriately large charge amount achieves a good image quality without fog adhesion and dispersion. However, the highly charged toner layer may return to the supply section without being consumed in the developing region, which may cause the problems such as abnormal adhesion of the toner described before. Therefore, the toner layer which passed through the developing region must be discharged.

For this purpose, the electrically conductive member, in which at least the surface contacting the toner carrying member is formed of the electrically conductive material, is disposed in the area from the developing region to the toner restricting member, and the voltage $V_D$ is applied to the electrically conductive member. Thereby, the model expression described before can be satisfied between the electrically conductive member and the toner layer, so that the following expression where $E_{TD}$ is the electric field by the toner layer at the position of the electrically conductive member can be obtained.

$$E_{TD}=E_K-k(V_B-V_D)$$

The difference in the electric field of the toner layer before and after it passes the electrically conductive member can be expressed as follows.

$$E_{TB}-E_{TD}=k(V_{BLD}-V_D)$$

Therefore, under the following conditions:

$V_D>V_{BLD}$ in the case of use of the negatively chargeable toner, and $V_D<V_{BLD}$ in the case of use of the positively chargeable toner, the charge amount corresponding to the difference between $V_D$ and $V_{BLD}$ is removed from the toner layer after the development, and thus the toner layer is discharged. The discharged toner layer, which has returned to the toner supply side, has the property allowing easy separation from the surface of the toner carrying member, and thus the abnormal adhesion and others can be prevented.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
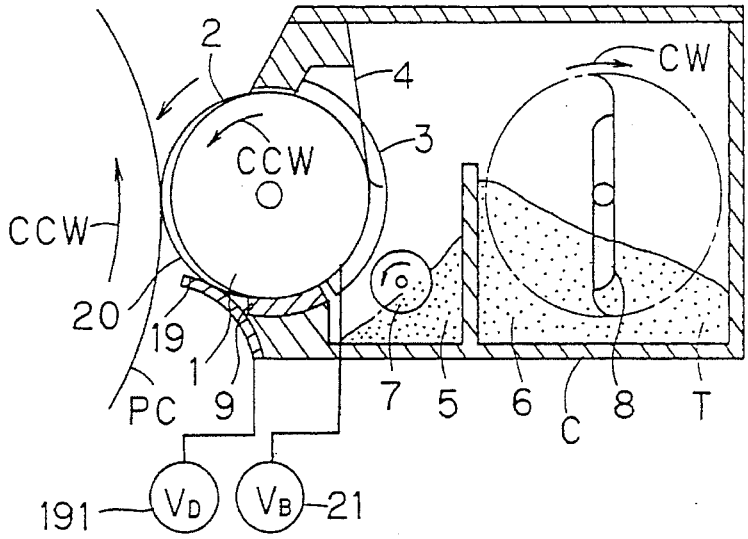
FIG. 1 is a schematic cross section of a developing device of an embodiment of the invention.
Figure 2:
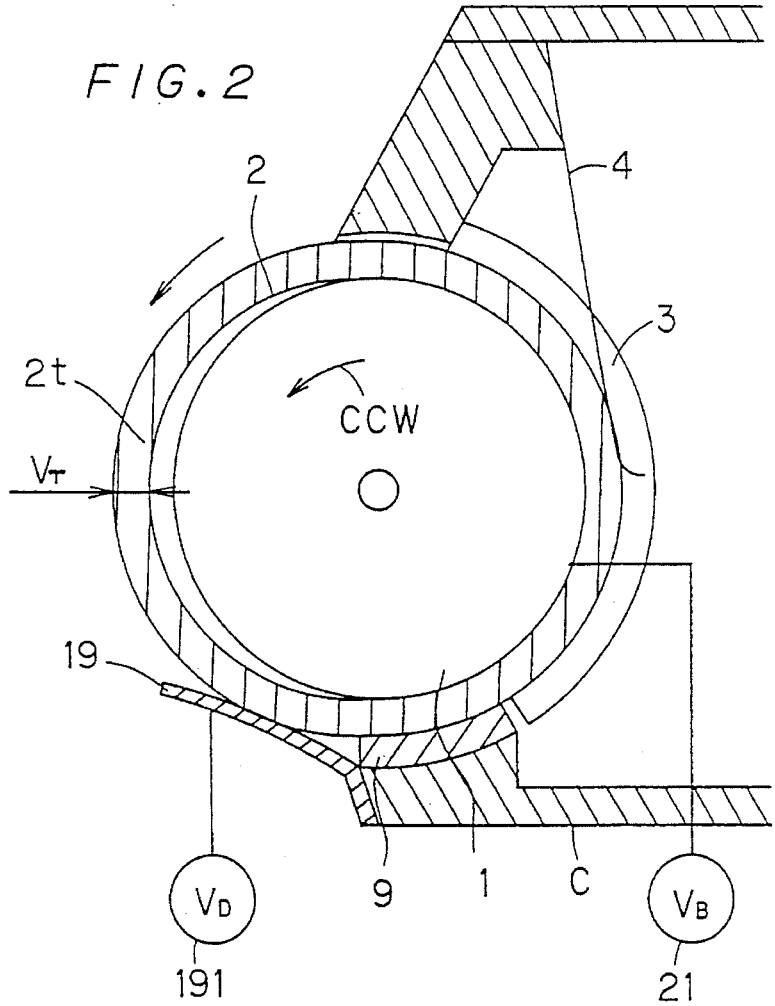
FIG. 2 is a fragmentary enlarged cross section of the developing device in FIG. 1.
Figure 3:
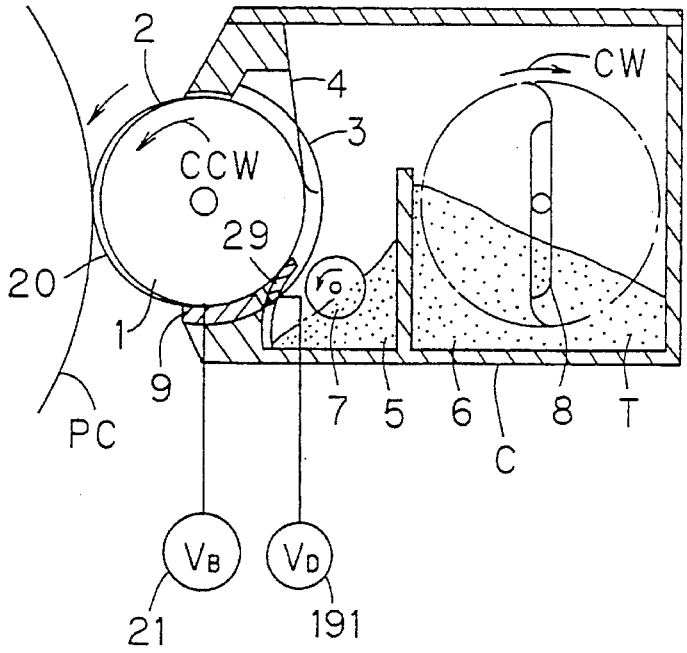
FIG. 3 is a schematic cross section of a developing device of another embodiment of the invention.
Figure 4:
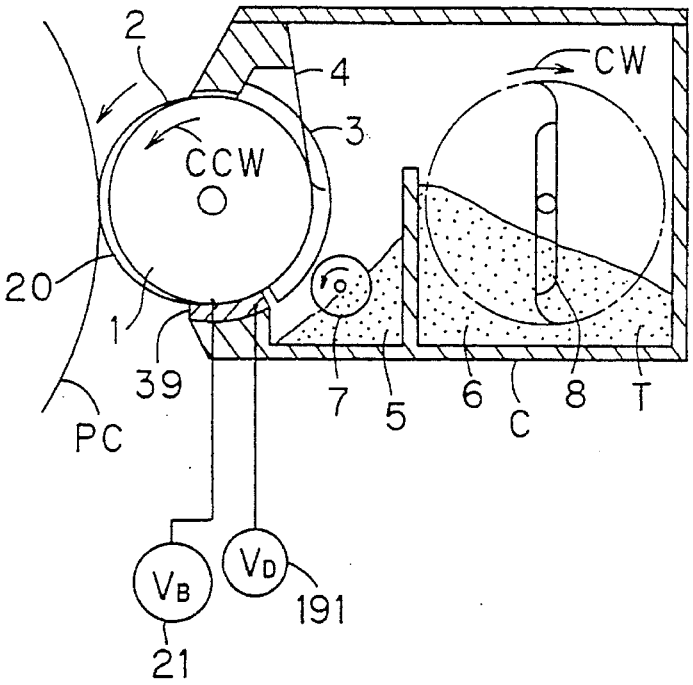
FIG. 4 is a schematic cross section of a developing device of still another embodiment of the invention.

Embodiments of the invention will be described below with reference to the drawings. FIG. 1 is a schematic cross section of an one-component developing device of an embodiment of the invention, and FIG. 2 is a fragmentary enlarged cross section of the developing device in FIG. 1. FIG. 3 is a schematic cross section of an one-component developing device of another embodiment of the invention, and FIG. 4 is a schematic cross section of an one-component developing device of still another embodiment of the invention.

These developing devices have a structure substantially similar to that shown in FIG. 15, except for that they include discharging members which will be described below.

A reference number 1 indicates a drive roller, 2 indicates a flexible developing sleeve fitted around the roller 1, 3 indicates a pressing guide for pressing the sleeve 2 against the drive roller 1, 4 indicates a toner restricting blade contacting the developing sleeve 2, 5 indicates a buffer chamber, 6 indicates a toner supply chamber, 7 indicates a toner supply rotary member disposed in the buffer chamber 5, 8 indicates a toner agitating and supplying rotary member disposed in the toner supply chamber 6, and T indicates toner to be used. The drive roller 1 and the member 7 are driven in the CCW direction in the figure by an unillustrated drive motor, and the member 8 is driven in the CW direction in the figure by the unillustrated drive motor. A slackened portion 20 is formed in the developing sleeve 2 by the pressing action of the pressing guide 3. The slackened portion 20 is located at a position in the developing sleeve 2 diametrally opposite to the pressed portion, and is in soft contact with a surface of a photosensitive drum PC of a copying machine in the illustrated embodiment.

The developing sleeve 2 is disposed in the opening of the housing C, and the toner restricting blade 4 is disposed in the housing to form a partition with respect to an exterior.

In each of the developing device shown in FIGS. 1 and 2 and the developing device shown in FIG. 3, 9 indicates a lower sealing member which is made of soft material such as moltplain having elasticity, and serves to prevent the toner T from externally leaking from the buffer chamber 5.

In the developing deice shown in FIGS. 1 and 2, a discharging member 19 which is in contact with the developing sleeve 2 is disposed in an area extending from the developing region, in which the developing sleeve 2 confronts the photosensitive drum PC, to the lower sealing member 9. In the developing device shown in FIG. 3, a discharging member 29 which is in contact with the developing sleeve 2 is disposed at an area extending from the lower sealing member 9 to the toner restricting blade 4. In the developing device shown in FIG. 4, the lower sealing member 9 in the devices shown in FIG. 1 and 3 is replaced with a discharging member 39 which exhibits the same function as the member 9 and confronts the developing sleeve 2. The discharging members 19, 29 and 39 are carried by a housing C of the developing device.

The decharging member 19 contacts a toner layer 2*t* (see FIG. 2) through an entire area extending perpendicularly to the surface moving direction CCW of the developing sleeve 2. The discharging members 29 and 39 are in contact with the surface of the developing sleeve 2, similarly to the discharging member 19.

In any of the developing device, the discharging member is located at the area extending from a position, which is downstream to the developing region with respect to the rotating direction of the developing sleeve 2, to the toner restricting blade 4. In the developing device provided with the discharging member 39 which also serves as the lower sealing member as shown in FIG. 4, the contact pressure against the developing sleeve 2 is restricted in a certain range due to the fact that it must also serve as the sealing member. However, it is not necessary to provide the discharging member independent from the sealing member, so that the developing device in FIG. 4 is advantageous in view of its manufacturing cost.

All the discharging members 19, 29, 39 are formed of material having a charge polarity which is shifted to the same polarity side as the regular charge polarity of the toner T in view of the charge series, compared with the toner T. Further, all the discharging members contain highly conductive material dispersed therein. Any of the discharging members 19, 29, 39 are connected to a discharging bias power supply 191 and receive a discharging bias potential $V_D$.

The discharging bias potential $V_D$ is selected as follows in view of the surface potential of the toner layer, which is the sum of the developing bias $V_B$ applied to the developing sleeve 2 by the power supply 21 and the potential $V_T$ of the toner layer 2*t* generated by the charging of the toner, in order to achieve smooth movement of the charge to the discharging member from the surplus toner layer which remains on the developing sleeve 2 without being consumed after the development of the electrostatic latent image on the photosensitive drum PC.

In the case of use of the negatively chargeable toner;

bias potential $V_D$>toner layer surface potential ($V_B+V_T$) (<developing bias), and in the case of use of the positively chargeable toner;

bias potential $V_D$<toner layer surface potential ($V_B+V_T$) (>developing bias).

The above inequalities are expressed taking plus and minus of the potentials into consideration.

In the examples described above, the discharging bias power supply 191 is a DC power supply, but alternatively, an AC power supply which supplies an alternating voltage may be employed.

Figure 5:
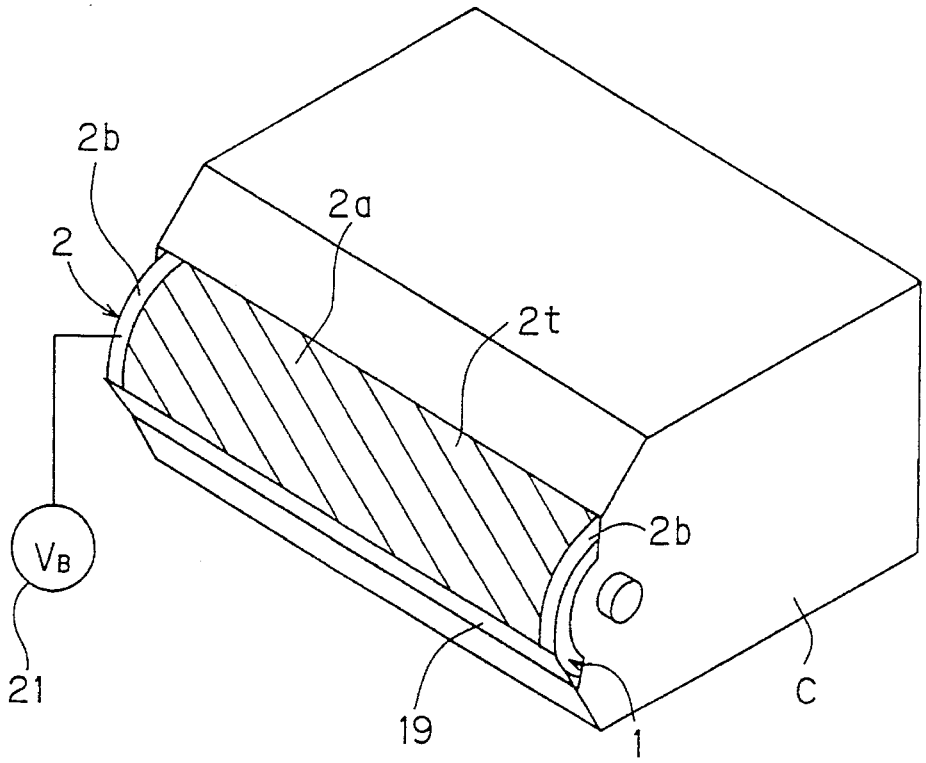
FIG. 5 is a perspective view of a developing device of further another embodiment of the invention.

As shown in FIG. 5, the developing sleeve 2 has a central portion 2*a* which is used for transporting the toner and holding a toner layer 2*t*, as is done in the conventional one-component developing device. However, the toner layer is not formed on the opposite ends of the developing sleeve 2 so that leak of the toner from the opposite ends may be prevented. Accordingly, as representatively shown in connection with the discharging member 19 in FIG. 2, the following structure may be employed. The discharging member contacts the central portion 2*a* through the toner layer 2*t*, and directly contacts the opposite ends 2*b*, so that the developing bias potential $V_B$ in a range satisfying the voltage conditions described above is simultaneously applied also to the discharging member, whereby the discharging member has the potential equal to the voltage applied to the developing sleeve. Also owing to this, a contact point for applying the voltage to the discharging member is not required, the discharging member can be electrically isolated from the developing sleeve 2, and an insulating member for preventing the leak can be eliminated. Accordingly, the structure described above with reference to FIG. 5 is advantageous in view of the cost, and may be employed in the discharging members 29 and 39.

According to each of the developing devices described above, the unconsumed toner T, which were held on the surface of the developing sleeve 2 and was supplied to the developing region for the development, passes through the discharging member 19 (or 29 or 39) and the sleeve 2 while contacting the sleeve 2, and returns to the buffer chamber 5.

When the toner contacts and passes through the discharging member, it is discharged or oppositely charged by the friction with the member, so that the toner returned to the buffer chamber 5 has a property allowing easy separation from the surface of the developing sleeve 2.

Since the discharging member contains the highly conductive material dispersed therein, the charge, which is generated in the discharging member by the friction between the discharging member and the toner T passing through and contacting the same, escapes through the highly conductive material, and thus the discharging member is prevented from accumulating the charge. Therefore, even if the image forming operations are repeated many times, and the toner on the developing sleeve 2 repetitively contacts the discharging member many times, the toner is discharged or oppositely charged every time the above operation is carried out.

In the developing devices described above, the discharging member 19 (or 29 or 39) contacts the toner layer through the full length thereof in the longitudinal direction of the developing sleeve 2. Alternatively, such a structure may be employed that the discharging member contacts only portions of the toner layer located on the opposite ends of the developing sleeve 2. The reason of this is as follows. The pressing force applied to the opposite ends of the developing sleeve 2 by the restricting blade 4 is smaller than that applied to the central portion, and a force restricting the adhesion of the toner to the sleeve 2 is weak in the opposite ends, so that the abnormal adhesion of the toner and the toner filming described before are liable to generate at the opposite ends, and thus the problems such as the abnormal adhesion of the toner and the filming may generate in the end portions even in the case where not problem generates in the central portion of the sleeve.

Figure 6:
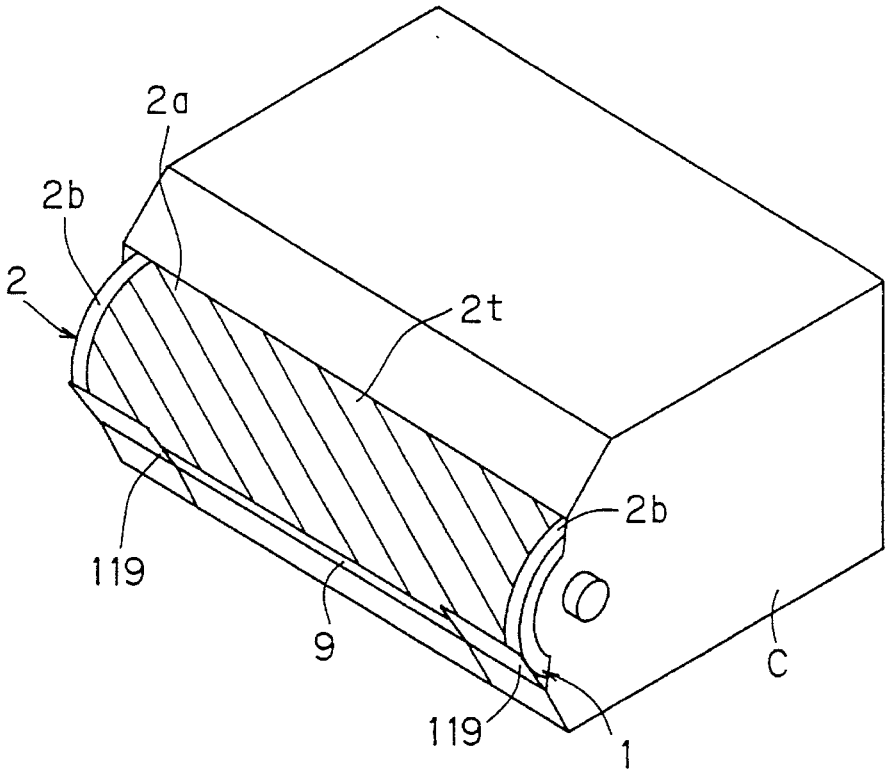
FIG. 6 is a perspective view of a developing device of yet another embodiment of the invention.
Figure 7:
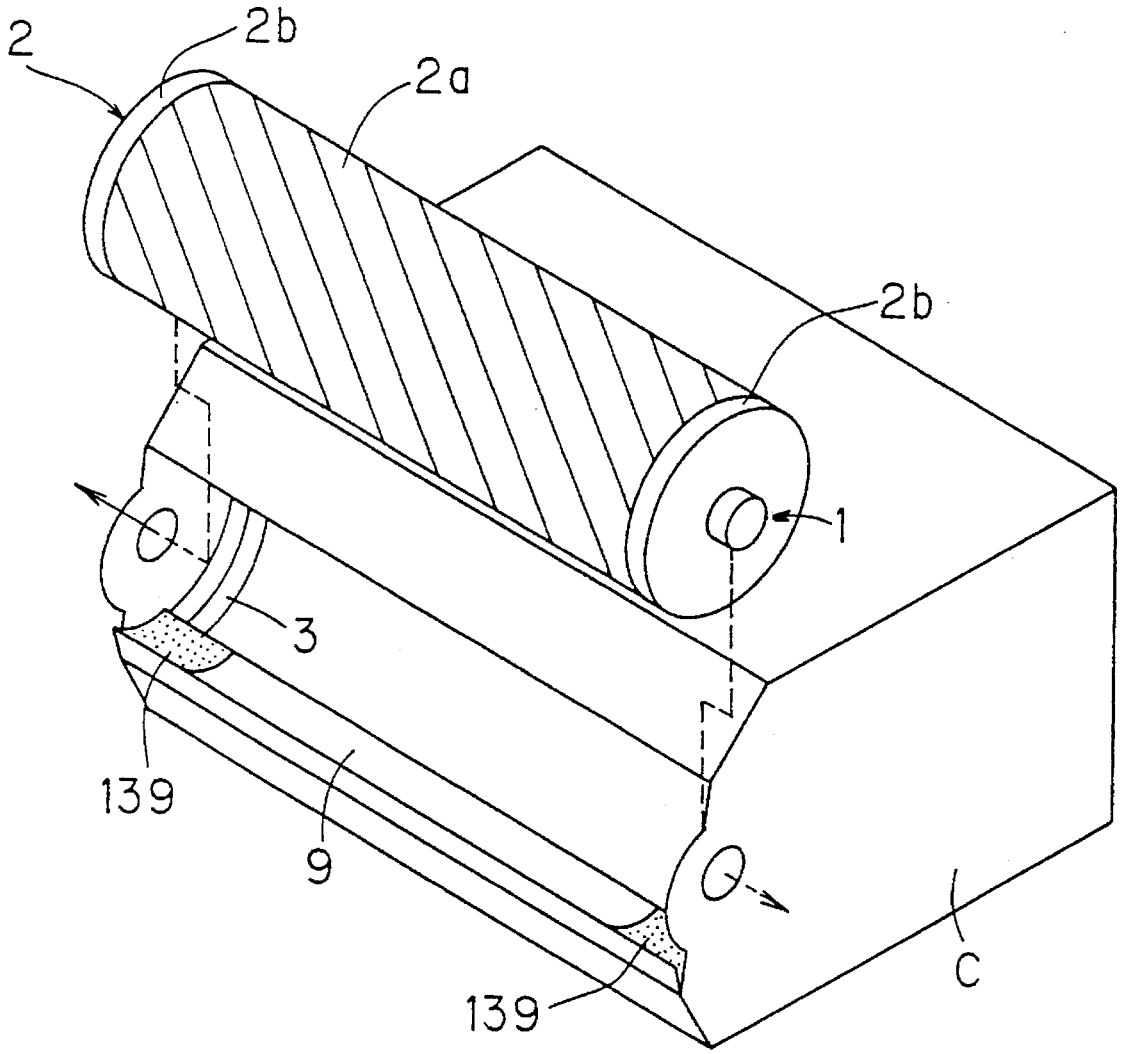
FIG. 7 is an exploded perspective view of a developing device of a further embodiment of the invention.

FIGS. 6 and 7 show examples in which discharging members 119 and 139 are provided for the toner layers on the end portions of the developing sleeve 2 as described above. The material and conductivity of these discharging members are the same as those of the discharging members 19, 29 and 39 described before. In the developing device shown in FIG. 6, the discharging member 119 is provided in an area between the developing region and the lower sealing member 9. In the developing device in FIG. 7, the discharging member 139 also functions as a part of the lower sealing member 9.

Then, experimental examples 1 and 2 as well as examples for comparison which employ various conditions relating to the toner T, discharging members and others will be described below.

[Experimental Example 1]

Toner T: Negatively chargeable toner formed as follows.

Thermoplastic polyester resin 100 weight parts, anti-offset additive (low-molecular-weight polypropylene) 3 weight parts, carbon block MA#100 (manufactured by Mitsubishi Kasei Corp.) 10 weight parts, and Spilon Black TRH (manufactured by Hodogaya Kagaku Corp.) 3 weight parts are put into a 10-liter Henschel mixer and are mixed for 2 minutes at 200 rpm. Thereafter, continuous kneading and extrusion are carried out by PCM30 (liter/d: 32.5) and then are cooled. Thereafter, it is roughly crushed by a feather mill of 2 mm mesh, and is further pulverized by a jet pulverizer. Then, the rough powder and fine powder are cut by an air classifier to form particles having an average diameter of 11 μm. Hydrophobic silica (R-974: manufactured by Nippon Aerosil Kabushiki Kaisha) is applied at a rate of 0.2 wt % to the surfaces of the particles.

Discharging member: This is formed of tape (manufactured by Nitto Denko Corp., No. 903SC) made of tetrafluoroethylene resin and carbon powder dispersed therein. As shown in FIG. 4, this serves also as the lower sealing member, and is in contact with the opposite ends of the developing sleeve 2 as shown in FIG. 5.

Developing sleeve 2: made of nickel

Toner restricting blade 4: made of stainless steel

Toner supply rotary member 7: made of aluminum

Photosensitive drum PC: Negatively chargeable photosensitive drum

[Example 1 for Comparison]

Discharging member: This is formed of tape made of only tetrafluoroethylene resin.

This serves also as the lower sealing member similarly to that shown in FIG. 4, but is electrically isolated from the developing sleeve 2.

The other conditions are the same as the experimental example 1.

| | Evaluation | | |
|---|---|---|---|
| | Non-image part Toner Development | Sleeve Filming | Solid Black Followability |
| EEX 1 | O | O | O |
| EXC 1 | O | O | X |

In the above table, "EEX" indicates the experimental example, and "EXC" indicates the example for comparison.

[Experimental Example 2]

Toner T: Positively chargeable toner formed as follows.

Thermoplastic styrene-acrylate resin 100 weight parts, anti-offset additive (low-molecular-weight polypropylene) 3 weight parts, carbon block MA#100 (manufactured by Mitsubishi Kasei Corp.) 10 weight parts, and Bontron N-01 (manufactured by Orient Kagaku Kogyo Corp.) 3 weight parts are used, and are processed in the same manner as the negatively chargeable toner described before.

Discharging member: This is formed of a sheet made of nylon and carbon powder dispersed at 22 wt % therein. As shown in FIG. 4, this serves also as the lower sealing member, and is in contact with the opposite ends of the developing sleeve 2 as shown in FIG. 5.

Photosensitive drum PC: Positively chargeable photosensitive drum

The other conditions are the same as the experimental example 1.

[Example 2 for Comparison]

Discharging member: This is formed of a sheet made of only nylon.

Discharging member: This serves as the lower sealing member similarly to that shown in FIG. 4, but is electrically isolated from the developing sleeve 2.

The other conditions are the same as the experimental example 2.

| | Evaluation | | |
|---|---|---|---|
| | Non-image part Toner Development | Sleeve Filming | Solid Black Followability |
| EEX 2 | O | Δ | O |
| EXC 2 | O | Δ | Δ |

In the above evaluations, the "O" mark represents a good state in which there is not toner development of a non-image portion, a good state in which no toner filming is generated on the developing sleeve 2, or a good state concerning the solid black followability, the "Δ" mark represents a relatively defective state, and the "X" mark represents an unacceptable state.

The above evaluation was obtained by visually observing the images on copy sheets and the surfaces of the developing sleeves 2 after the continuous operation for 10 hours of copying machines using the developing devices constructed in accordance with the above conditions. The solid black followability was evaluated by measuring the image densities at the forward and rear ends of the copied image with a reflection densitometer, and the image was evaluated as acceptable if the difference in density is not more than 0.2.

As can be seen from the comparison of the evaluation of the experimental example 1 and the example 1 for comparison, as well as the comparison of the evaluation of the experimental example 2 and the example 2 for comparison, the experimental examples 1 and 2 which use the discharging members containing the highly conductive material dispersed therein can achieve good results, as a whole, compared with the examples 1 and 2 for comparison not using such discharging member containing the highly conductive material dispersed therein.

According to the experimental examples 1 and 2 in the present invention, as described hereinbefore, since the carbon powder having the good conductivity is dispersed in the discharging members, the surplus toner can be easily separated from the developing sleeve 2 even after the image formation was repeated many times, so that an appropriate amount of the toner can be transferred to the developing region and the toner can be charged to an appropriate extent. Therefore, the problems such as filming of the toner on the developing sleeve 2 and deterioration of the toner (which may results in insufficient solid black followability) can be suppressed, and thus a good image quality can be obtained as a whole.

In the experimental examples described above, the discharging members are made of the material such as tetrafluoroethylene resin or nylon, of which charge polarity is shifted toward the same polarity as the regular charge polarity of the toner. Alternatively, the discharging member may have the charge polarity shifted toward the same polarity as the regular charge polarity of the toner which is achieved by using a resin or metal member and charge controlling substance dispersed therein or applied thereto in a form of a thin film.

The above charge controlling substance may be electron donating dye (e.g., nigrosine dye or phthalocyanine dye), amine alkoxide, quaternary ammonium salt (including activator), alkylamidoline, tungsten, tungsten compound, chelate molybdate, fluorine activator or hydrophobic silica,etc. in the case of use of the positively chargeable toner. The above charge controlling substance may be electron accepting dye (monoazo pigment metal complex salt), electron accepting organic complex, chlorinated polyolefin, chlorinated polyester, hyperacid-radical polyester, sulfonyl amine of copper phthalocyanine, oil black, naphthenic metal salt, fatty acid metal salt or resin acid soap,etc. in the case of the negatively chargeable toner.

A further embodiment of the invention will be described below with reference to FIG. 8. An one-component developing device shown in FIG. 8 has a structure similar to that of the developing device shown in FIGS. 1 and 2. The same parts as those shown in FIGS. 1 and 2 bear the same reference numbers. The device in FIG. 8 differs from the device shown in FIGS. 1 and 2 in that the toner restricting blade 4 receives the bias potential $V_{BLD}$ from the bias power supply 41 connected thereto. Also in this device, the developing sleeve 2 is connected to the developing bias power supply 21 for receiving the developing bias potential $V_B$, and the discharging member 19 is connected to the bias power supply 191 for receiving the discharging bias potential $V_D$.

The purpose of applying the bias voltage $V_{BLD}$ to the toner restricting blade 4 is to increase the charge amount of the toner held on the developing sleeve 2 and thereby to control this charge amount. The bias potential $V_D$ and $V_{BLD}$ are determined to satisfy the relationship of $V_D>V_{BLD}$ in the case of use of the negatively chargeable toner and to satisfy the relationship of $V_D<V_{BLD}$ in the case of use of the positively chargeable toner. The above inequalities are expressed taking plus and minus into consideration.

Owing to the application of the bias voltages to the toner restricting blade 4 and the discharging member 19, the toner layer before the development can maintain the charge amount required for the development, and the toner layer after the development can be discharged by reducing the charge amount in accordance with the difference between $V_D$ and $V_{BLD}$. Further, the toner layer, which is returned to the buffer chamber 5 by the developing sleeve 2 holding the toner layer thereon after the development, can be easily separated from the surface of the sleeve 2, and thereby the conventional problems such as abnormal adhesion of the toner can be prevented.

Figure 8:
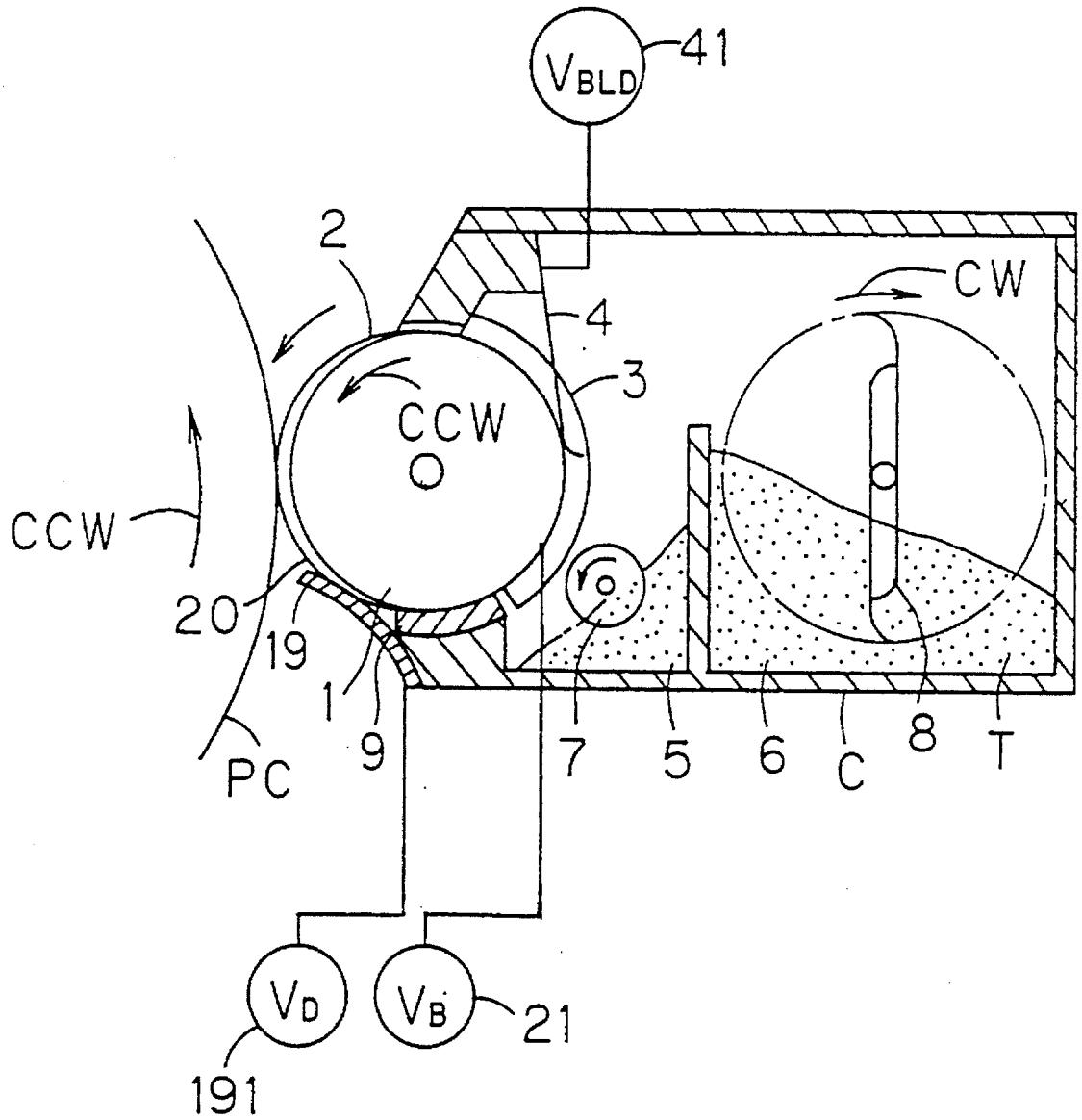
FIG. 8 is a schematic cross section of a developing device of a still further embodiment of the invention.

The developing devices shown in FIGS. 3 and 4 can also achieve the effect similar to that by the device shown in FIG. 8 by employing the structure similar to that of the device shown in FIG. 8, and specifically by employing the structure in which the bias power supply 41 is connected to the toner restricting blade 4 to apply the bias potential $V_{BLD}$ thereto, the discharging bias potential $V_D$ is applied to the discharging members 29 and 39, and the bias potential $V_D$ and $V_{BLD}$ are determined to satisfy the relationship of $V_D>V_{BLD}$ in the case of use of the negatively chargeable toner and to satisfy the relationship of $V_D<V_{BLD}$ in the case of use of the positively chargeable toner.

As representatively shown in connection with the discharging member 19 in FIG. 5, the discharging member may be in direct contact with the opposite ends **2*b* of the developing sleeve 2 which do not bear the toner layer so that the discharging member may attain the same potential $V_B$ as the developing sleeve 2**. Further, the bias potentials may be determined to satisfy the relationship of $V_B(=V_D)>V_{BLD}$ in the case of use of the negatively chargeable toner and to satisfy the relationship of $V_B(=V_D)<V_{BLD}$ in the case of use of the positively chargeable toner. Thereby, the similar effect can be obtained.

If the potentials are to be determined to satisfy the relationship of $V_B=V_D$, it is not necessary to provide a contact for applying the voltage to the discharging member, to form electrical connection between the discharging member and the developing sleeve 2 and to provide an insulating member for preventing leak, resulting in a low cost.

Further, even in the case where the bias potential is applied to the toner restricting blade 4 as described above, the discharging member may be in contact with only the opposite ends of the developing sleeve 2, as is done in the developing device shown in FIGS. 6 and 7.

Under the conditions of the experimental examples 1 and 2, which have already been described in connection with the structure not applying the bias potential to the toner restricting blade 4, the power supply 41 may be connected to the blade 4 for applying the bias potential $V_{BLD}$ as shown in FIG. 8, and the potentials may be determined to satisfy the relationship of $V_B(=V_D)>V_{BLD}$ in the case of the experimental example 1 using the negatively chargeable toner and to satisfy the relationship of $V_B(=V_D)<V_{BLD}$ in the case of the experimental example 2 using the positively chargeable toner. A copying operation was carried out using the structure and conditions described above. As a result, it was found that the problems such as the abnormal adhesion of the toner on the developing sleeve 2, the filming and the deterioration of the toner were suppressed, and a good image without fog adhesion and dispersion of the toner was obtained as a whole.

According to the respective developing devices described above, the surplus toner which was held by the toner carrying member and was supplied for the development can easily separate from the toner carrying member even after the image forming operation was repeated many times, and thereby the amount of the toner transferred to the developing region and the charge amount of the toner are maintained at appropriate values, so that the problems such as accumulation of the toner on the developer carrying member, the deterioration of the toner and the filming of the toner are suppressed, and thus a good image without fog adhesion and dispersion of the toner can be obtained as a whole.

Figure 13:
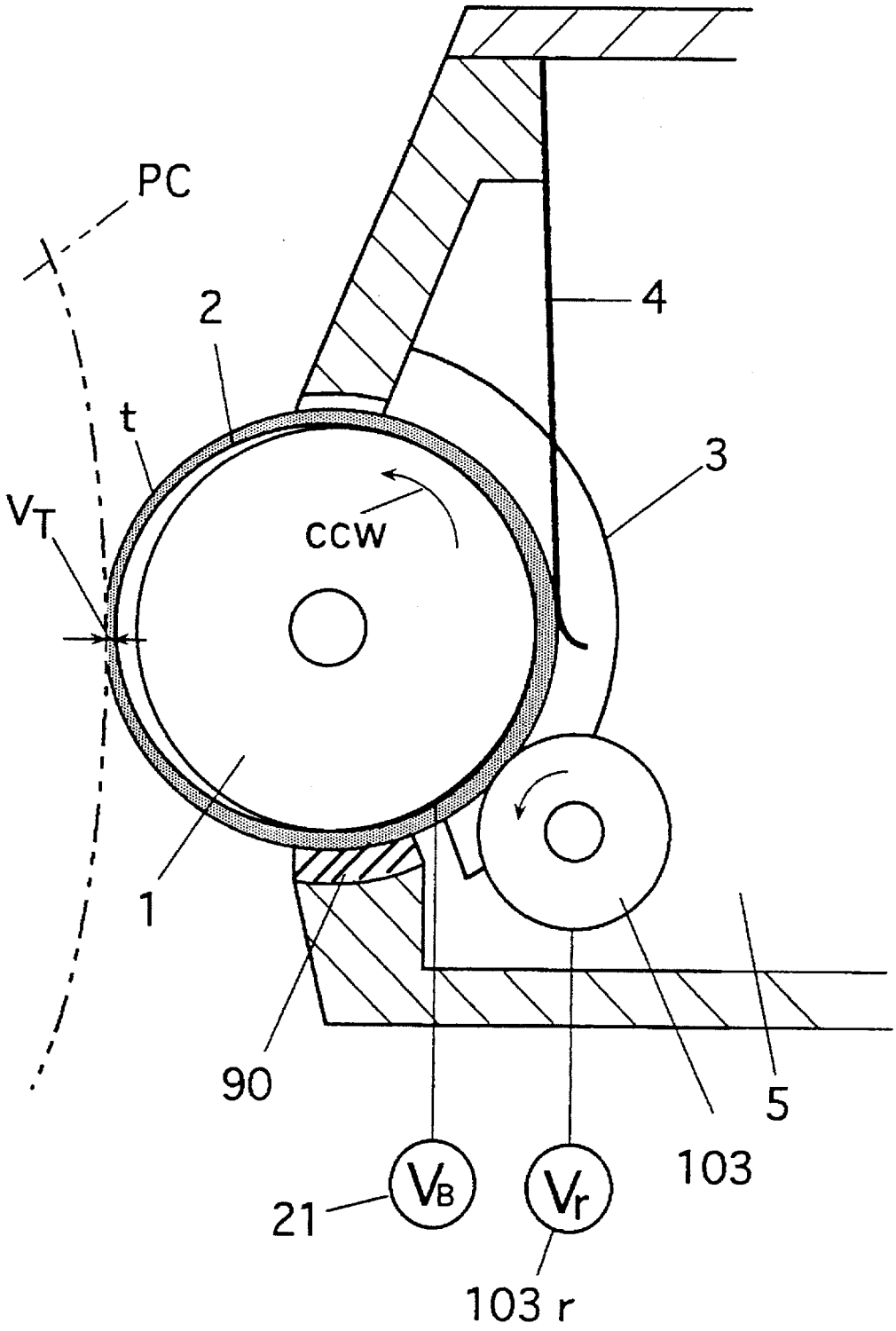
FIG. 13 is an enlarged fragmentary cross section schematically showing a further embodiment of the invention.
Figure 14:
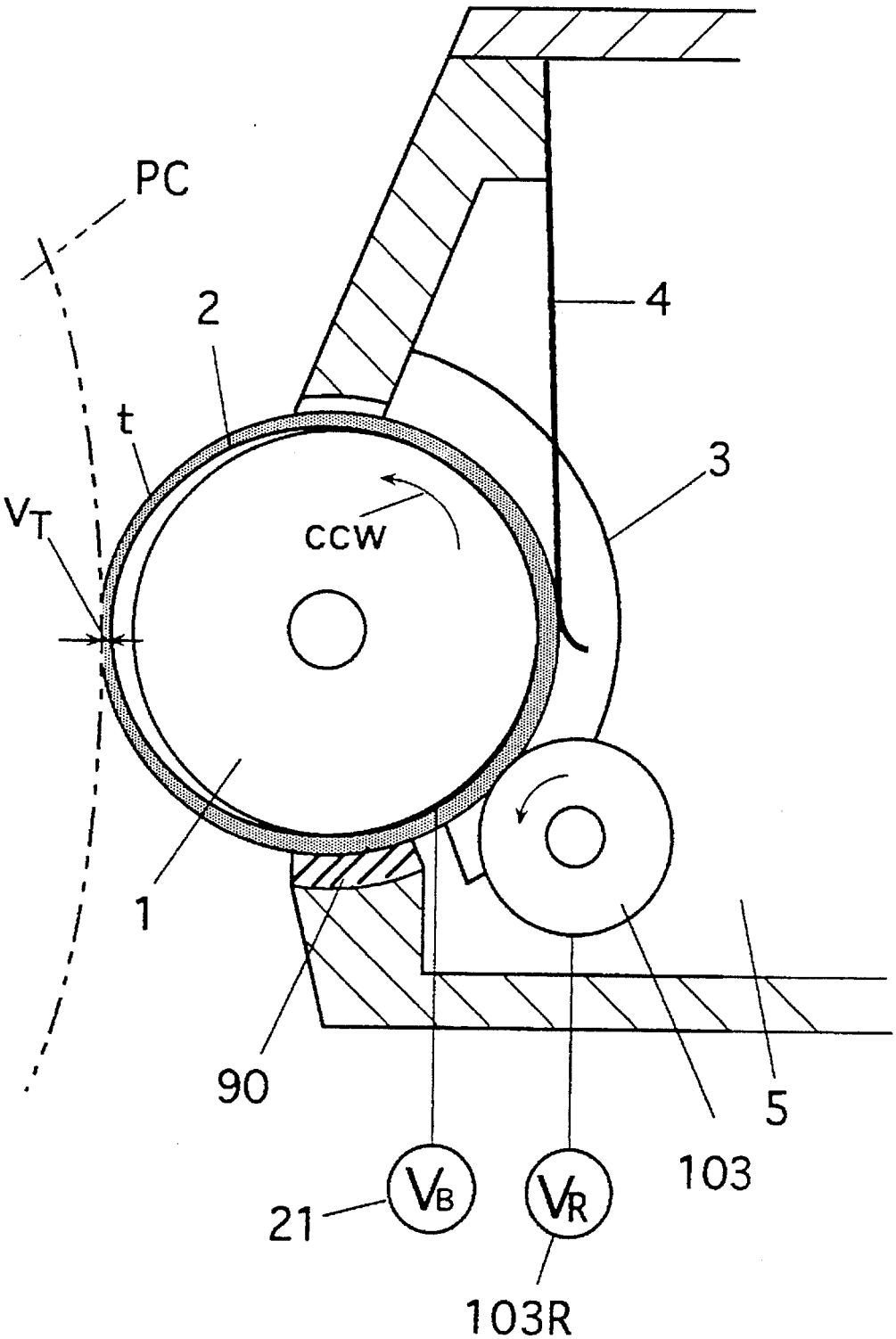
FIG. 14 is an enlarged fragmentary cross section schematically showing a further embodiment of the invention.

Further embodiments of the invention will be described below with reference to FIGS. 9 to 14. FIGS. 9 to 12 are schematic cross sections of further different embodiments of the invention, respectively, and FIGS. 13 and 14 are enlarged fragmentary cross sections schematically showing still further different embodiments of the invention, respectively. Respective developing devices shown in FIGS. 9 to 14 have the substantially same structures and operations as those of the conventional developing device shown in FIG. 15 except for that they are provided with a discharging member and a surplus toner removing member which will be described later.

In each of the developing devices shown in FIGS. 9 to 14, a reference number 1 indicates a drive roller, 2 indicates a flexible developing sleeve fitted around the roller 1, 3 indicates a pressing guide for pressing the sleeve 2 against the drive roller 1, 4 indicates a toner restricting blade contacting the developing sleeve 2, 5 indicates a buffer chamber, 6 indicates a toner supply chamber, 8 indicates a toner agitating and supplying rotary member disposed in the toner supply chamber 6, 90 indicates a discharging member which is in contact with the lower surface of the developing sleeve 2 and also serves as a lower sealing member preventing leakage of the toner from the buffer chamber 5. C indicates a device housing, and T indicates the toner to be used. A power supply 21 applies a developing bias $V_B$ to the developing sleeve 2. The discharging member 90 will be described in detail later.

Figure 9:
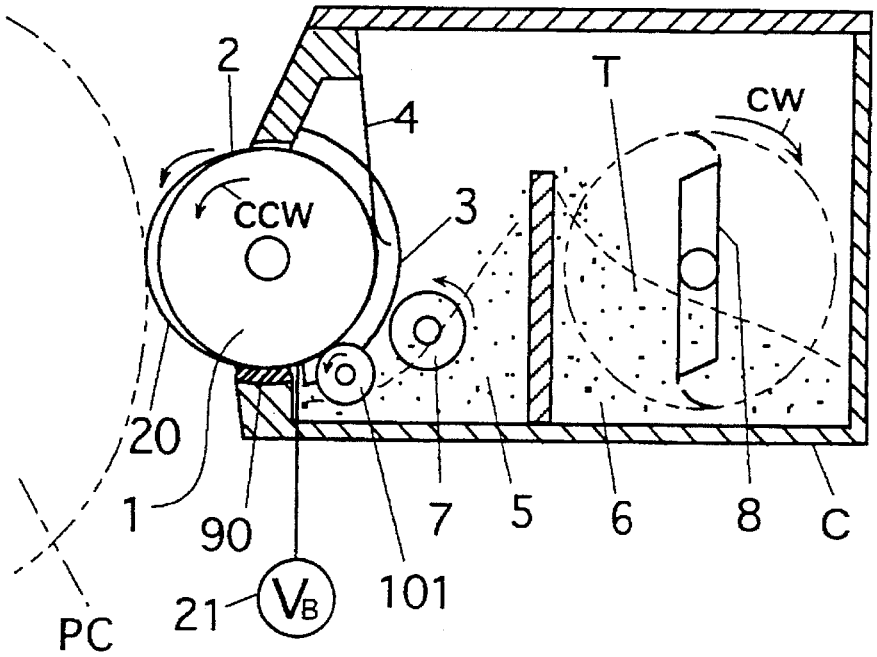
FIG. 9 is a schematic cross section of a further embodiment of the invention.
Figure 10:
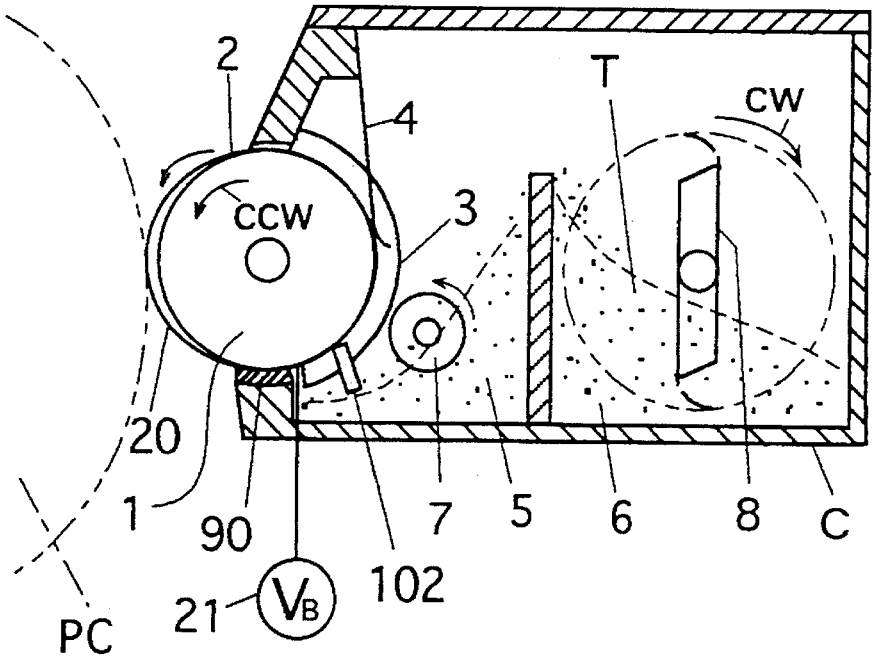
FIG. 10 is a schematic cross section of a further embodiment of the invention.

In each of the developing devices shown in FIGS. 9 and 10, 7 indicates a toner supply rotary member disposed in the buffer chamber 5. The device shown in FIG. 9 includes a surplus toner removing member 101 in the form of a rotary roller. The device shown in FIG. 10 includes a surplus toner removing member 102 in the form of a blade. These removing members are in contact with the developing sleeve 2 at a region between the discharging member 90 and the toner supply rotary member 7.

Figure 11:
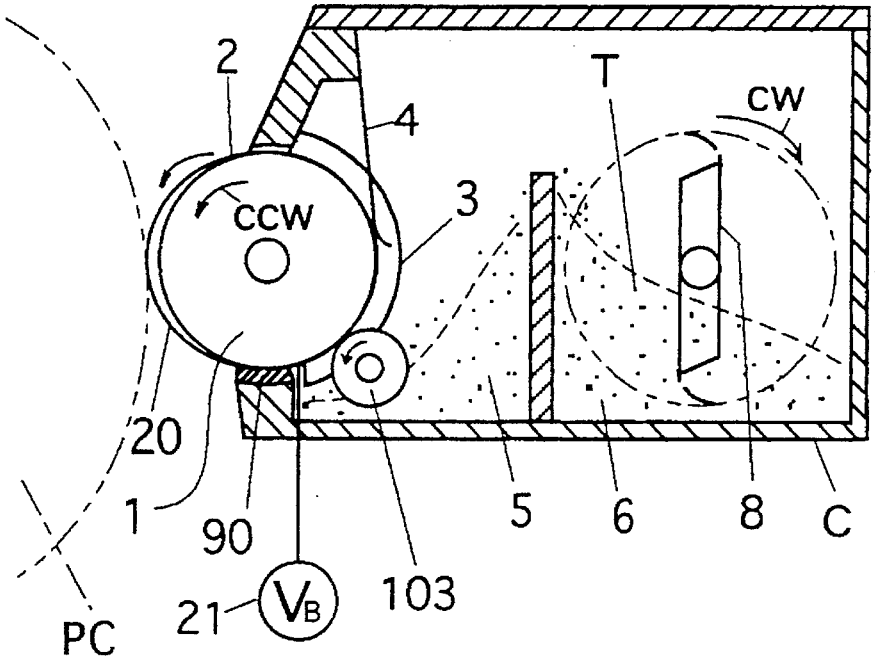
FIG. 11 is a schematic cross section of a further embodiment of the invention.
Figure 12:
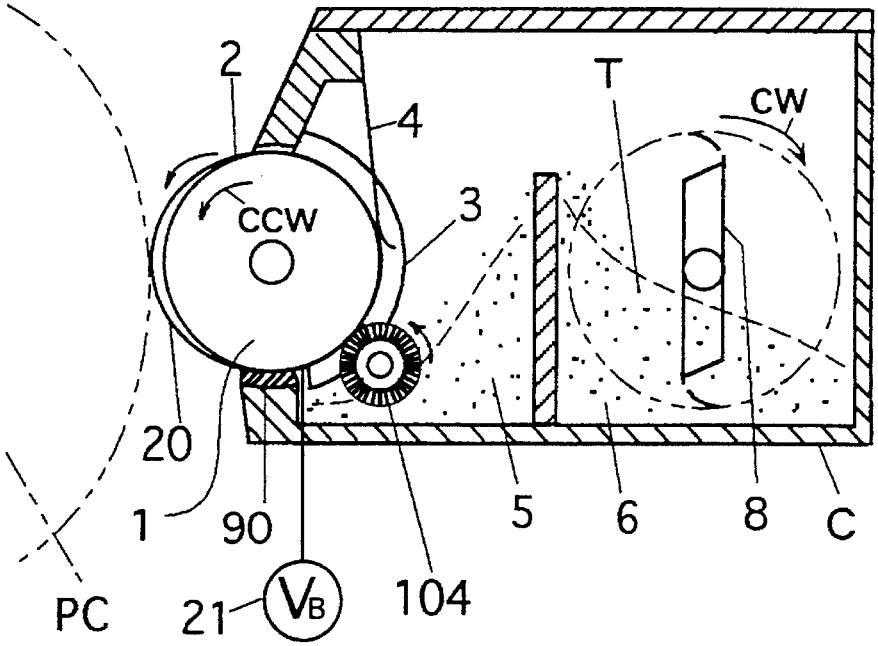
FIG. 12 is a schematic cross section of a further embodiment of the invention.

In the developing device shown in FIG. 11, 103 indicates a surplus toner removing member in the form of a rotary roller, which also serves as the same member as the toner supply rotary member 7 in the devices shown in FIGS. 9 and 10. In the developing device shown in FIGS. 12, 104 indicates a surplus toner removing member in the form of a rotary brush roller, and likewise serves as the same member as the toner supply rotary member 7 in the devices shown in FIGS. 9 and 10. Brush hairs of the brush portion of the member 104 are made of electrically conductive fibers.

The developing device shown in FIG. 13 corresponds to the developing device shown in FIG. 11, and additionally has such a feature that the removing member 103 is electrically conductive and is connected to a bias power supply 103*r* to apply a surplus toner removing bias potential Vr thereto. The bias potential Vr is set to satisfy the following relationship between the bias potential (Vr) and a surface potential ($V_B$+$V_T$) of the toner layer which is the sum of the developing bias potential $V_B$ applied to the developing sleeve 2 and the potential $V_T$ of the toner layer t on the sleeve 2 caused by charging the toner.

If toner is negatively chargeable: $Vr>V_B+V_T$

If toner is positively chargeable: $Vr<V_B+V_T$

The above inequalities are determined taking the positive and negative of the respective potentials into consideration.

A developing device in FIG. 14 corresponds to the developing device shown in FIG. 11, and additionally has such a feature that the removing member 103 is electrically conductive, and is connected to an alternating bias power supply 103R for applying an alternating bias $V_R$ thereto.

In the developing devices shown in FIGS. 11 to 14, the removing members 103 and 104 are disposed in the lower portion of the buffer chamber 5 for facilitating supply of the toner to the developing sleeve 2, and are in contact with the developing sleeve 2. These removing members 103 and 104 and the rotary removing member 101 in the device shown in FIG. 9 may be rotated in either direction, but in the illustrated embodiments, are rotated in the same direction as the developing sleeve 2 by an unillustrated drive device, so that the surface of the member may move in the opposite direction with respect to the surface of the developing sleeve contacting the same, whereby even highly charged toner on the sleeve can be surely removed.

In each of the developing devices described above, the drive roller 1, the toner supply rotary member 7 and the toner removing rotary members 101, 103 and 104 are rotated in the counterclockwise direction CCW in the figure by the unillustrated drive device, and the toner agitating and supplying rotary member 8 is rotated in the clockwise direction CW in the figure by the unillustrated drive device. In the illustrated embodiment, a slackened portion 20, which is formed in the developing sleeve 2 by the pressing action of the pressing guide 3 and is located at a position in the developing sleeve 2 diametrally opposite to the pressed portion, is in soft contact with a surface of a photosensitive drum PC of an image forming apparatus.

The discharging member 90 serving as the lower sealing member contacts the surface of the developing sleeve 2 through an entire length, i.e., an entire area extending across the surface moving direction CCW of the sleeve 2, and the toner layer t is interposed therebetween (see FIGS. 13 and 14). In each of the developing device, as described above, the discharging member 90 is disposed in an area extending from the position downstream to the developing region, with respect to the rotating direction of the developing sleeve 2, to the toner restricting blade 4. The discharging member and the sealing member may be provided independently, but the illustrated developing device employs the discharging member 90 serving as the sealing member, in which case the contact pressure against the developing sleeve 2 must be selected within a certain range because the member 90 must serve as the sealing member, but it is not necessary to provide a dedicated discharging member in addition to a sealing member, resulting in advantage relating to the manufacturing cost of the developing device.

The discharging member 90 in each embodiment is made of material having a charge polarity which is shifted to the same polarity side as the regular charge polarity of the toner T in view of the charge series, compared with the toner T, and material having high electrical conductivity is dispersed in the discharging member 90.

In each of the developing devices, a discharging bias power supply may be connected to the discharging member 90 to apply the discharging bias potential $V_D$ thereto.

The discharging bias potential $V_D$ may be determined to satisfy the relationship described below between the bias potential ($V_D$) and the surface potential ($V_B$+$V_T$) of the toner layer which is the sum of the developing bias potential $V_B$ applied to the developing sleeve 2 from the power supply 21 and the potential $V_T$ of the toner layer t caused by charging the toner. According to the discharging bias potential ($V_D$) thus determined, the electric charges can move smoothly to the discharging member from the unconsumed surplus toner layer remaining on the developing sleeve 2 after development of the electrostatic latent image on the photosensitive drum PC.

If toner is negatively chargeable:

bias potential $V_D$>toner surface potential ($V_B$+$V_T$) (<developing bias)

If toner is positively chargeable:

bias potential $V_D$<toner surface potential ($V_B$+$V_T$) (>developing bias)

The above inequalities are determined taking the positive and negative of the respective potentials into consideration.

According to the developing devices shown in FIGS. 9 to 14, the toner T was held on the surface of the developing sleeve 2 and was supplied to the developing region for development. Then, the unconsumed toner T is brought into contact with the discharging member 90 which is in contact with the sleeve 2, and will return to the buffer chamber 5 after moving between the discharging member 90 and the sleeve 2.

When the toner contacts and moves over the discharging member 90, it is discharged or oppositely charged to a small extent due to friction with the discharging member 90, so that the toner returned to the buffer chamber 5 can be easily separated from the surface of the developing sleeve 2.

Since the highly conductive material is dispersed in the discharging member, the charges, which generate in the discharging member due to friction of the discharging member and the toner T contacting and moving over the same, escape through the highly conductive member, so that the charges are prevented or suppressed from being accumulated in the discharging member. Accordingly, even if the image forming operation is repeated many times and the toner on the developing sleeve 2 contacts and moves over the discharging member many times, the toner is discharged or oppositely charged each time the toner contacts the discharging member.

The surplus toner returned to the buffer chamber 5 is separated from the developing sleeve 2 by the toner removing member 101 (FIG. 9), 102 (FIG. 10), 103 (FIGS. 11, 13 and 14) or 104 (FIG. 12), and the toner in the developing device is supplied to the developing sleeve again.

According to the removing member 103 shown in FIGS. 13 and 14, since the removing biases Vr and $V_R$ are applied to the member 103, the surplus toner can be removed more reliably owing to the application of the removing biases even if the discharging member 90 could not sufficiently perform the discharging effect.

Experimental examples 3 and 4 as well as an example for comparison will be described below. These examples use or employ the following toner T, discharging member 90, surplus toner removing member 103 and others.

[Experimental Example 3] (Experiment With the Device Shown in FIG. 11)

Toner T: Negatively chargeable toner formed as follows.

Thermoplastic polyester resin 100 weight parts, anti-offset additive (low-molecular-weight polypropylene) 3 weight parts, carbon block MA#100 (manufactured by Mitsubishi Kasei Corp.) 10 weight parts, and Spilon Black TRH (manufactured by Hodogaya Kagaku Corp.) 3 weight parts are put into a 10-liter Henschel mixer and are mixed for 2 minutes at 200 rpm. Thereafter, continuous kneading and extrusion are carried out by PCM30 (liter/d: 32.5) and then are cooled. Thereafter, it is roughly crushed by a feather mill of 2 mm mesh, and is further pulverized by a jet pulverizer. Then, the rough powder and fine powder are cut by an air classifier to form particles having an average diameter of 8 m. Hydrophobic silica (R-974: manufactured by Nippon Aerosil Kabushiki Kaisha) is applied at a rate of 0.2 wt % to the surfaces of the particles.

Discharging member: This is formed of tape (manufactured by Nitto Denko Corp., No. 903SC) made of tetrafluoroethylene resin and carbon powder dispersed therein.

Developing sleeve 2: made of nickel

Toner restricting blade 4: made of stainless steel

Surplus toner removing member 103: foam moltplain

Photosensitive drum PC: Negatively chargeable photosensitive drum

Developing bias $V_B$ to developing sleeve 2: −300 V

[Experimental Example 4] (Experiment With the Device Shown in FIG. 13)

Surplus toner removing member 103: foam moltplain containing dispersed carbon black Removing bias to removing member 103: −300 V The bias Vr is set to satisfy the condition of $Vr>V_B+V_T$, where the toner layer potential $V_T$ achieved by the charging is −100 V.

The other conditions are the same as those of the experimental example 3.

[Example for Comparison]

Figure 15:
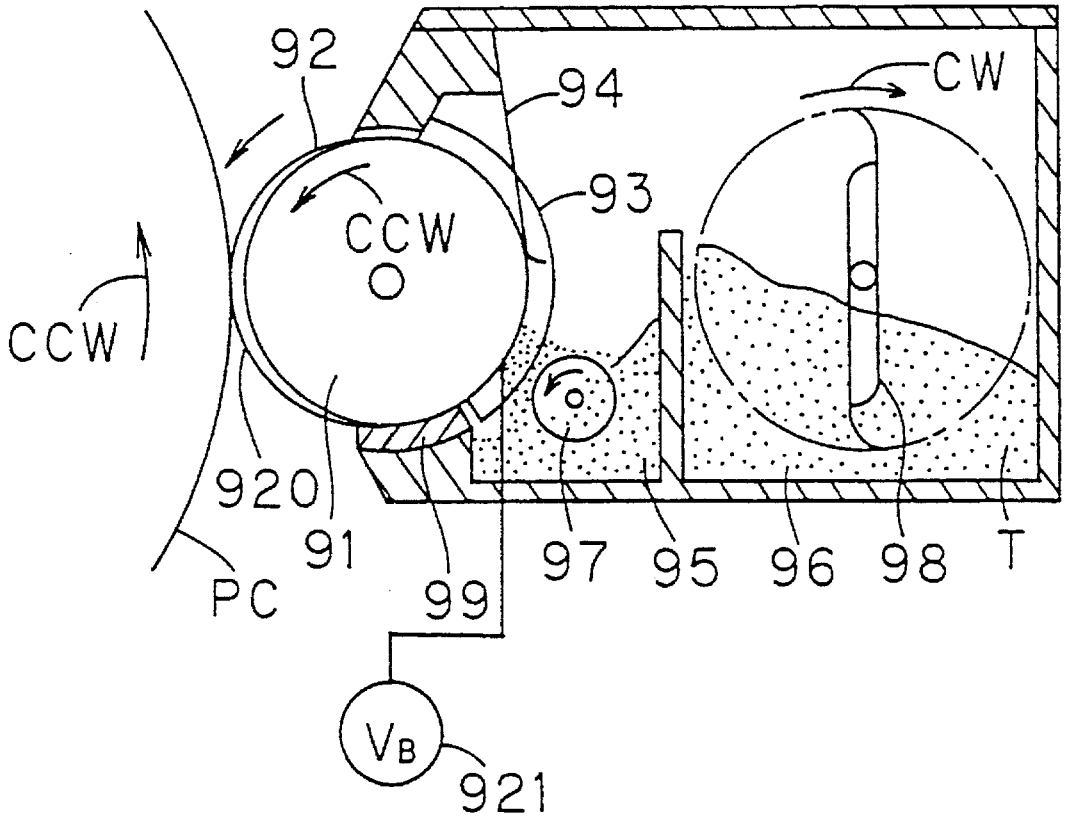
FIG. 15 (PRIOR ART)
FIG. 15 is a schematic cross section of a developing device in the prior art.

The conventional developing device shown in FIG. 15 is used. The toner T, developing sleeve 92, toner restricting blade 94, photosensitive drum PC and developing bias $V_B$ used in this example are the same as those of the experimental example 3.

In the above experimental examples and the example for comparison, white image formation (which does not theoretically consume the toner) was repeated with an entirely white original, and the average particle diameter of the toner held on the developing sleeve 2 was measured. The result is described below. The memories on the sleeve are also described below. Further, the result relating to the quality of the image after actually repeating the image formation is also described below. In the following list, the "◎" marks (double circular marks) represent an extremely good state in which any sleeve memory did not appear at the image portion and an extremely good image quality was obtained. The "O" marks (circular marks) represent a good state in which sleeve memory did not substantially appear at the image portion and a good image quality was obtained. The "X" marks (cross marks) represent an unacceptable state in which sleeve memory appeared at the image portion and an acceptable image quality was not obtained.

| | Toner Av. Diameter | Sleeve Memory | Image Quality |
|---|---|---|---|
| EEX 3 | 7.5 μm | O | O |
| EEX 4 | 8.0 μm | ◎ | ◎ |
| EXC | 6 μm | X | X |

From the above result of experiments, the following can be understood. In spite of the fact that the used toner has a relatively small particle diameter, the surplus toner held on the developing sleeve 2 after used for the developing is set by the discharging member 90 to the state that it can be easily separated from the developing sleeve 2, and is actively removed by the surplus toner removing member, which prevents problems such as accumulation of the toner on the developing sleeve 2, deterioration of the toner, filming of the toner as well as the problems such as memory on the developing sleeve which may be caused with the toner particles of a small diameter and deterioration of the image quality after printing of many sheets.

As described above, the developing devices shown in FIGS. 9 to 14 can prevent problems such as accumulation of the toner on the toner carrying member, deterioration of the toner, filming of the toner as well as the problems such as memory on the toner carrying member which may be caused with the toner particles of a small diameter and deterioration of the image quality after printing of many sheets.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A one-component developing device for developing an electrostatic latent image on an electrostatic latent image carrier comprising:

a toner carrying member which is opposed to said electrostatic latent image carrier and has a movable surface for holding said toner thereon;

a toner restricting member located at a position, which is upstream, with respect to a moving direction of said surface of said toner carrying member, to a developing region formed in opposed portions of said electrostatic latent image carrier and said toner carrying member, said toner restricting member being in contact with said surface of said toner carrying member; and an electrically conductive member located in a region extending from a position, which is downstream, with respect to the moving direction of said surface of said toner carrying member, to said developing region, to a position upstream to said toner restricting member, said electrically conductive member being in contact with said surface of said toner carrying member and being formed of a material which contains electrically conductive substance dispersed therein, said material further having, within the context of a frictional charge series having two sides, a charge polarity on the same side as a charge polarity of said toner.

2. A developing device as claimed in claim 1, wherein said electrically conductive member serves as a sealing member for preventing leak of said toner.

3. A developing device as claimed in claim 1, further comprising a sealing member for preventing leak of said toner, which is in contact with said surface of said toner carrying member and is disposed at a position downstream, with respect to the moving direction of said surface of said toner carrying member, to said developing region.

4. A developing device as claimed in claim 3, wherein said sealing member is formed of a material which has a charge polarity on the same side as the charge polarity of said toner within the context of the frictional charge series.

5. A developing device as claimed in claim 3, wherein said electrically conductive member is disposed between said developing region and said sealing member.

6. A developing device as claimed in claim 3, wherein said electrically conductive member is disposed between said sealing member and said toner restricting member.

7. A developing device as claimed in claim 3, wherein said electrically conductive member is in contact with a substantially and longitudinally entire area of said toner carrying member.

8. A developing device as claimed in claim 3, wherein said electrically conductive member is in contact with an end portion of a longitudinal direction of said toner carrying member.

9. A developing device as claimed in claim 1, wherein said electrically conductive member is made of resin of which charge polarity is in the same side as the charge polarity of said toner in view of the frictional charge series.

10. A developing device as claimed in claim 1, wherein said electrically conductive member contains charge controlling agent of which charge polarity is in the same side as the charge polarity of said toner in view of the frictional charge series.

11. A developing device as claimed in claim 1, wherein a voltage is applied to said electrically conductive member.

12. A developing device as claimed in claim 11, wherein said voltage applied to said electrically conductive member is larger than a voltage applied at a surface of a toner layer on said toner carrying member when negatively chargeable toner is used.

13. A developing device as claimed in claim 11, wherein said voltage applied to said electrically conductive member is smaller than a voltage applied at a surface of a toner layer on said toner carrying member when positively chargeable toner is used.

14. A developing device as claimed in claim 11, wherein said voltage applied to said electrically conductive member is an alternating voltage.

15. A developing device as claimed in claim 1, further comprising a removing member for removing toner from the surface of said toner carrying member, which is in contact with said surface of said toner carrying member at a position downstream to the electrically conductive member and upstream to the toner restricting member with respect to the moving direction of said toner carrying member.

16. A developing device as claimed in claim 15, wherein a voltage, Vr, is applied to said removing member.

17. A developing device as claimed in claim 16, wherein Vr is set to satisfy the following relationship between Vr and a surface potential $V_B+V_T$ of a toner layer on the toner carrying member, wherein $V_B$ is a bias potential applied to said toner carrying member, and $V_T$ is a potential of said toner layer caused by charging of the toner:

if toner is negatively chargeable: $Vr>V_B+V_T$ if toner is positively chargeable: $Vr<V_B+V_T$.

18. A developing device as claimed in claim 15, wherein said removing member is a blade.

19. A developing device as claimed in claim 15, wherein said removing member is a roller having an electrically conductive brush therearound.

20. An one-component developing device for developing an electrostatic latent image on an electrostatic latent image carrier comprising:

a toner carrying member which is opposed to said electrostatic latent image carrier and has a movable surface for holding said toner thereon, a voltage being applied to said toner carrying member;

a toner restricting member located at a position, which is upstream, with respect to a moving direction of said surface of said toner carrying member, to a developing region formed in opposed portions of said electrostatic latent image carrier and said toner carrying member, said toner restricting member being in contact with said surface of said toner carrying member and a voltage different from the voltage applied to said toner carrying member being applied to said toner restricting member, and an electrically conductive member located in a region extending from a position, which is downstream, with respect to said moving direction of said surface of said toner carrying member, to said developing region, to a position upstream to said toner restricting member, said electrically conductive member being in contact with said surface of said toner carrying member; and means for applying a voltage $V_{BLD}$ to said toner restricting member, the voltage $V_{BLD}$ being smaller than a voltage $V_D$ applied to said electrically conductive member in the case where said toner is negatively chargeable toner, and being larger than said voltage $V_D$ in the case where said toner is positively chargeable toner.

21. A developing device as claimed in claim 20, wherein said electrically conductive member is formed of a material which contains electrically conductive substance dispersed therein, said material further having, in the context of a frictional charge series having two sides, a charge polarity on the same side as a charge polarity of said toner.

22. A developing device as claimed in claim 20, wherein said electrically conductive member is a sealing member for preventing leak of the toner.

23. A developing device as claimed in claim 20, further comprising a sealing member for preventing leak of the toner, which is in contact with said surface of said toner carrying member and is located at a position downstream, with respect to the moving direction of said surface of said toner carrying member, to said developing region.

24. A developing device as claimed in claim 23, wherein said sealing member is formed of a material which has a charge polarity on the same side as a charge polarity of said toner within the context of a frictional charge series.

25. A developing device as claimed in claim 23, wherein said electrically conductive member is disposed between said developing region and said sealing member.

26. A developing device as claimed in claim 23, wherein said electrically conductive member is disposed between said sealing member and said toner restricting member.

27. A developing device as claimed in claim 23, wherein said electrically conductive member is in contact with a substantially and longitudinally entire area of said toner carrying member.

28. A developing device as claimed in claim 23, wherein said electrically conductive member is in contact with an end portion in a longitudinal direction of said toner carrying member.

29. An one-component developing device for developing an electrostatic latent image on an electrostatic latent image carrier comprising:

a toner carrying member including a thin film developing sleeve which is loosely mounted around a drive roller and has a peripheral length slightly longer than a peripheral length of said drive roller, said drive roller being driven to rotate;

a member for forming a slackened portion in said developing sleeve located at a position at which said electrostatic latent image carrier and said toner carrying member are opposed to each other;

a toner restricting member located at a position, which is upstream, with respect to a moving direction of a surface of said toner carrying member, to a developing region formed in opposed portions of said electrostatic latent image carrier and said toner carrying member, said toner restricting member being in contact with said surface of said toner carrying member, and an electrically conductive member which is located in a region extending from a position downstream, with respect to said moving direction of said surface of said toner carrying member, to said developing region to a position upstream to said toner restricting member, is in contact with said surface of said toner carrying member and is made of material of which charge polarity is in the same side as a charge polarity of the toner, and which contains electrically conductive material dispersed therein.

30. A developing device as claimed in claim 29, wherein a voltage $V_{BLD}$ is applied to said toner restricting member and a voltage $V_D$ is applied to said electrically conductive member.

31. A developing deice as claimed in claim 30, wherein said voltage $V_{BLD}$ applied to said toner restricting member is smaller than said voltage $V_D$ applied to said electrically conductive member in the case where said toner is negatively chargeable toner, and said voltage $V_{BLD}$ is larger than said voltage $V_D$ in the case where said toner is positively chargeable toner.

32. A one-component developing device for developing an electrostatic latent image on an electrostatic latent image carrier comprising:

a housing having an opening;

a toner carrying member which is disposed in said opening of said housing, is opposed to said electrostatic latent image carrier and has a movable surface for holding said toner thereon;

a toner restricting member located at a position, which is in said housing and is upstream, with respect to a moving direction of said surface of said toner carrying member, to a developing region formed in opposed portions of said electrostatic latent image carrier and said toner carrying member, said toner restricting member being in contact with said surface of said toner carrying member;

an electrically conductive member attached to said housing and located in a region extending from a position, which is downstream, with respect to the moving direction of said surface of said toner carrying member, to said developing region, to a position upstream to said toner restricting member, said electrically conductive member being in contact with said surface of said toner carrying member and being formed of material which contains electrically conductive substance dispersed therein, said material further having, within the context of a frictional charge series having two sides, a charge polarity on the same side as a charge polarity of said toner; and a toner storing portion which is defined in said housing and is closed by said toner carrying member, said toner restricting member and said electrically conductive member with respect to an exterior.

33. A developing device as claimed in claim 32, wherein a removing member is disposed in said toner storing portion, said removing member being in contact with the surface of said toner carrying member for removing the toner therefrom.

34. A developing device as claimed in claim 33, wherein a voltage, Vr, is applied to said removing member.

35. A developing device as claimed in claim 34, wherein Vr is set to satisfy the following relationship between Vr and a surface potential $V_B+V_T$ of a toner layer on the toner carrying member, wherein $V_B$ is a bias potential applied to said toner carrying member, and $V_T$ is a potential of said toner layer caused by charging of the toner:

if toner is negatively chargeable: $Vr>V_B+V_T$ if toner is positively chargeable: $Vr<V_B+V_T$.

36. A developing device as claimed in claim 33, wherein said removing member is a blade.

37. A developing device as claimed in claim 33, wherein said removing member is a roller having an electrically conductive brush therearound.

38. A one-component developing device for developing an electrostatic latent image on an electrostatic latent image carrier comprising:

a toner carrying member which is opposed to said electrostatic latent image carrier and has a movable surface for holding said toner thereon;

a toner restricting member located at a position, which is upstream of a developing region, with respect to a moving direction of said surface of said toner carrying member, said toner restricting member being in contact with said surface of said toner carrying member; and an electrically conductive member located in a region extending from a position, which is downstream from said developing region, with respect to the moving direction of said surface of said toner carrying member, to a position upstream of said toner restricting member, said electrically conductive member being in contact with said surface of said toner carrying member and being formed of material having a triboelectric charge capacity similar to a triboelectric charge capacity of said toner.

39. A one-component developing device for developing an electrostatic latent image on an electrostatic latent image carrier comprising:

a toner carrying member which is opposed to said electrostatic latent image carrier and has a movable surface for holding said toner thereon;

a toner restricting member located at a position, which is upstream of a developing region, with respect to a moving direction of said surface of said toner carrying member, said toner restricting member being in contact with said surface of said toner carrying member; and an electrically conductive member located in a region extending from a position, which is downstream from said developing region, with respect to the moving direction of said surface of said toner carrying member, to a position upstream of said toner restricting member, said electrically conductive member being in contact with said surface of said toner carrying member and being formed of material having a charge polarity near a charge polarity of said toner.

* * * * *